US008970568B2

(12) United States Patent
Tsai et al.

(10) Patent No.: US 8,970,568 B2
(45) Date of Patent: Mar. 3, 2015

(54) DISPLAY DEVICE AND CONTROL METHOD THEREOF

(75) Inventors: Yung-Yu Tsai, Miao-Li County (TW); Chien-Chou Cheng, Miao-Li County (TW)

(73) Assignees: Innocom Technology (Shenzhen) Co., Ltd., Longhua Town, Shenzhen (CN); Innolux Corporation, Miao-Li County (TW)

( * ) Notice: Subject to any disclaimer, the term of this patent is extended or adjusted under 35 U.S.C. 154(b) by 220 days.

(21) Appl. No.: 13/612,741

(22) Filed: Sep. 12, 2012

(65) Prior Publication Data

US 2013/0314384 A1 Nov. 28, 2013

(30) Foreign Application Priority Data

May 25, 2012 (TW) ..... 101118661 A

(51) Int. Cl.
*G09G 5/00* (2006.01)

(52) U.S. Cl.
USPC ..... 345/204

(58) Field of Classification Search
None
See application file for complete search history.

(56) References Cited

U.S. PATENT DOCUMENTS

| | | | | |
|---|---|---|---|---|
| 2009/0021499 | A1* | 1/2009 | Chen et al. | 345/204 |
| 2009/0122052 | A1* | 5/2009 | Huang et al. | 345/213 |
| 2009/0322661 | A1* | 12/2009 | Bae et al. | 345/87 |
| 2011/0206290 | A1* | 8/2011 | Katayama et al. | 382/250 |

* cited by examiner

*Primary Examiner* — Lixi C Simpson
(74) *Attorney, Agent, or Firm* — McClure, Qualey & Rodack, LLP

(57) ABSTRACT

A display device is disclosed. A display panel displays a first image according to a first output image. A timing controller includes a receiving unit, a compression unit, a decompression unit and a processing unit. The receiving unit receives a first input image and a second input image and outputs a first processed image and a second processed image. The first input image is the same as the first processed image. The second input image is the same as the second processed image. The compression unit generates a first compressed image according to the first processed image. The receiving unit stores the first compressed image. The decompression unit processes the stored first compressed image to generate a first decompressed image. The processing unit processes the second processed image and the first decompressed image to generate the first output image.

18 Claims, 6 Drawing Sheets

DISPLAY DEVICE AND CONTROL METHOD THEREOF

CROSS REFERENCE TO RELATED APPLICATIONS

This Application claims priority of Taiwan Patent Application No. 101118661, filed on May 25, 2012, the entirety of which is incorporated by reference herein.

BACKGROUND OF THE INVENTION

1. Field of the Invention

The invention relates to a display device, and more particularly to a display device comprising a timing controller.

2. Description of the Related Art

Because cathode ray tubes (CRTs) are inexpensive and provide high definition, they are utilized extensively in televisions and computers. With technological development, new flat-panel displays are continually being developed. When a larger display panel is required, the weight of the flat-panel display does not substantially change when compared to CRT displays.

With an increase in the resolution of the display panel, an amount of image data required by the display panel is increased. To access the image data, a conventional method increases the number and bandwidth of memory. Thus, the cost of the flat-panel display is increased.

BRIEF SUMMARY OF THE INVENTION

In accordance with an embodiment, a display device comprises a display panel and a timing controller. The display panel displays a first image according to a first output image. The timing controller comprises a receiving unit, a compression unit, a decompression unit and a processing unit. The receiving unit receives a first input image and a second input image and outputs a first processed image and a second processed image. The first input image is the same as the first processed image. The second input image is the same as the second processed image. The compression unit generates a first compressed image according to the first processed image. The receiving unit stores the first compressed image. The decompression unit processes the first compressed image stored in the receiving unit to generate a first decompressed image. The processing unit processes the second processed image and the first decompressed image to generate the first output image.

A control method for a display device is provided. An exemplary embodiment of a control method for a display device is described in the following. A first input image and a second input image are received. A first processed image and a second processed image are provided according to the first and the second input images. The first processed image is the same as the first input image. The second processed image is the same as the second input image. A first compressed image is generated according to the first processed image. The first compressed image is stored. The stored first compressed image is decompressed to generate a first decompressed image. The second processed image and the first decompressed image are processed to generate a first output image. The first output image is provided to the display device to display a first image.

A detailed description is given in the following embodiments with reference to the accompanying drawings.

BRIEF DESCRIPTION OF THE DRAWINGS

The invention can be more fully understood by referring to the following detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
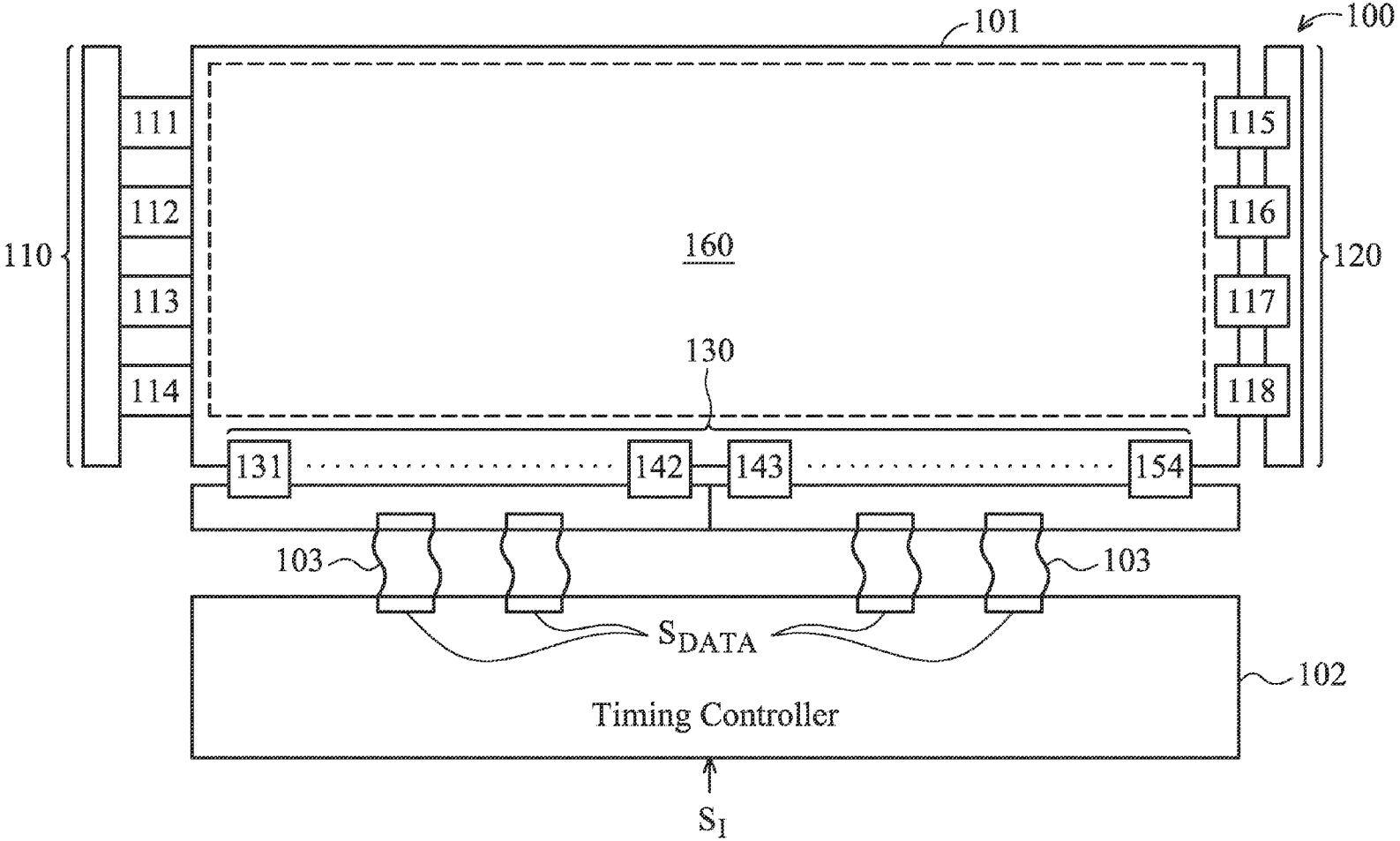
FIG. 1 is a schematic diagram of an exemplary embodiment of a display device.

FIG. 1 is a schematic diagram of an exemplary embodiment of a display device. The display device 100 comprises a display panel 101 and a timing controller (TCON) 102. The invention does not limit the kind of the display device 100. In one embodiment, the display device 100 is a personal digital assistant (PDA), a cellular phone, a digital camera (DSC), a television, a global positioning system (GPS), a car display, an avionics display, a digital photo frame, a notebook computer (NB), or a personal computer (PC).

The display panel 101 receives an output image $S_{DATA}$ provided by the timing controller 102 via a flexible printed circuit (FPC) 103 and displays a corresponding image according to the output image $S_{DATA}$. The invention does not limit the kind and the resolution of the display panel 101. In one embodiment, the display panel 101 is a self-luminescent panel or a reflective panel. In another embodiment, the display panel 101 is a quad full high definition (QFHS) panel and the resolution of the display panel 101 is 3840×2160.

In this embodiment, the display panel 101 comprises scan groups 110 and 120, a data group 130 and a display region 160, but the disclosure is not limited thereto. In other embodiments, any circuit structure can be applied in the display panel 101, as long as the circuit structure is capable of displaying an image in the display region 160.

As shown in FIG. 1, the scan group 110 is placed on the left hand side of the display region 160 and comprises gate drivers 111~114. The scan group 120 is placed on the right hand side of the display region 160 and comprises gate drivers 115~118. The gate drivers 111~118 provide a plurality of scan signals to pixels in the display region 160. The invention does not limit the number and the position of the scan groups. In one embodiment, the display panel 101 only comprises a single scan group and is placed on any side of the display region 160. In another embodiment, the number of the gate drivers is proportional to the number of the pixels in the display region 160.

In this embodiment, the data group 130 comprises source drivers 131~154 to provide a plurality of data signals to the pixels in the display region 160. The invention does not limit the number of the source drivers. In one embodiment, the number of the source drivers relates to the number of the pixels in the display region 160.

The timing controller 102 generates the output image $S_{DATA}$ to the display panel 101 according to an input image $S_I$. The invention does not limit the format of the input image $S_I$.

In one embodiment, the input image $S_I$ is in a low voltage differential signaling (LVDS) format.

Figure 2:
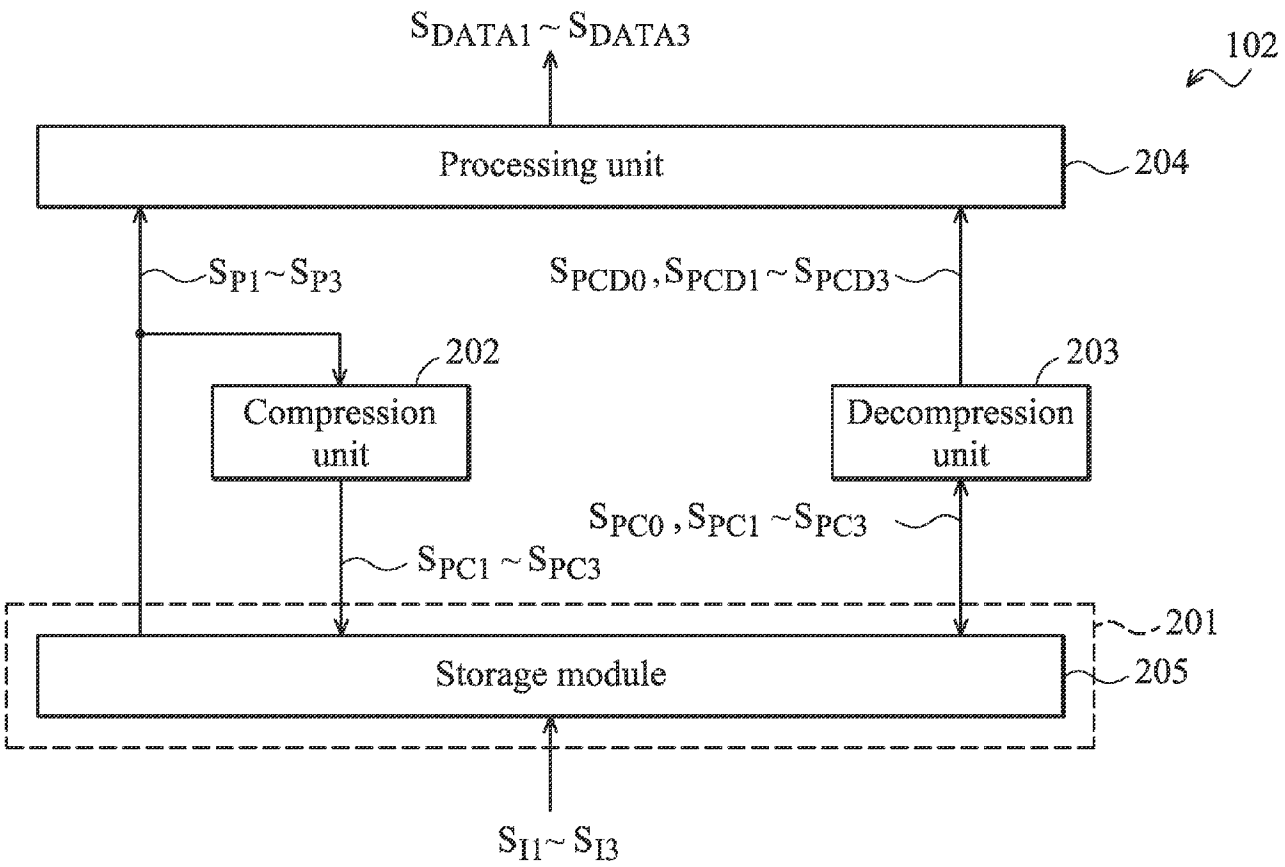
FIGS. 2-4 are schematic diagrams of other exemplary embodiments of a timing controller.

For clarity, only three input images $S_{I1}$~$S_{I3}$ and three output images $S_{DATA1}$~$S_{DATA3}$ are shown and taken as an example to describe the operation of the timing controller 102. FIG. 2 is a schematic diagram of an exemplary embodiment of a timing controller. In this embodiment, the timing controller 102 comprises a receiving unit 201, a compression unit 202, a decompression unit 203 and a processing unit 204.

The receiving unit 201 generates processed images $S_{P1}$~$S_{P3}$ according to the input images $S_{I1}$~$S_{I3}$. The invention does not limit how the receiving unit 201 generates the processed images $S_{P1}$~$S_{P3}$. In this embodiment, the receiving unit 201 comprises a storage module 205 to store the input images $S_{I1}$~$S_{I3}$. The storage module 205 acquires stored data according to an access signal (not shown) and serves the acquired data as a processed image (e.g. one of the processed images $S_{P1}$~$S_{P3}$) for the compression unit 202. In one embodiment, the storage module 205 comprises a dynamic random access memory (DRAM).

The compression unit 202 compresses the processed images $S_{P1}$~$S_{P3}$ to generate compressed images $S_{PC1}$~$S_{PC3}$ and stores the compressed images $S_{PC1}$~$S_{PC3}$ to the receiving unit 201. The decompression unit 203 decompresses the compressed images $S_{PC1}$~$S_{PC3}$ stored in the receiving unit 201 to generate decompressed images $S_{PCD1}$~$S_{PCD3}$. In this embodiment, the decompressed image $S_{PCD1}$ is the same as the input image $S_{I1}$, the decompressed image $S_{PCD2}$ is the same as the input image $S_{I2}$, and the decompressed image $S_{PCD3}$ is the same as the input image $S_{I3}$.

The processing unit 204 reads and processes the processed images $S_{P1}$~$S_{P3}$ provided by the receiving unit 201 to generate output images $S_{DATA1}$~$S_{DATA3}$. The display panel 101 displays three images according to the output images $S_{DATA1}$~$S_{DATA3}$. The invention does not limit how the processing unit 204 processes the processed images $S_{P1}$~$S_{P3}$ provided by the receiving unit 201. In one embodiment, the processing unit 204 processes the processed image $S_{P1}$ and a first previous image according to an overdriving (OD) procedure to generate the output image $S_{DATA1}$, processes the processed image $S_{P2}$ and a second previous image according to the OD to generate the output image $S_{DATA2}$, and processes the processed image $S_{P3}$ and a third previous image according to the OD procedure to generate the output image $S_{DATA3}$.

For example, during a first period, the receiving unit 201 receives and stores the input image $S_{I1}$. The processing unit 204 reads the input image $S_{I1}$ stored in the receiving unit 201, wherein the read result is served as a processed image $S_{P1}$. The processing unit 204 processes the processed image $S_{P1}$ and a decompressed image $S_{PCD0}$ to generate an output image $S_{DATA1}$ according to the OD procedure. The display panel 101 displays a first image according to the output image $S_{DATA1}$.

In one embodiment, the OD procedure requires two images, but no image occurs before the input image $S_{I1}$. Thus, the decompression unit 203 decompresses a pre-determined image $S_{PC0}$ stored in the storage module 205 and provides the decompressed result (i.e. $S_{PCD0}$) to the processing unit 204. In another embodiment, since no image occurs before the input image $S_{I1}$, the processing unit 204 does not execute the OD procedure for the processed image $S_{P1}$.

When the processing unit 204 processes the processed image $S_{P1}$, the compression unit 202 compresses a data segment, which was processed by the processing unit 204 and stores the compressed result to the storage module 205. Thus, after the processing unit 204 finishes the OD procedure, the compression unit 202 also finishes a compression action for the processed image $S_{P1}$. Additionally, since the compressed image $S_{PC1}$ replaces the input image $S_{I1}$ stored in the storage module 205, the bandwidth of the storage module 205 can be reduced and the usable space of the storage module 205 is increased.

During a second period, the receiving unit 201 receives and stores the input image $S_{I2}$. The processing unit 204 reads the input image $S_{I2}$ stored in the receiving unit 201, wherein the read result is served as a processed image $S_{P2}$. To execute the OD procedure, the decompression unit 203 reads and decompresses the compressed image $S_{PC1}$ stored in the storage unit 205 to generate a decompressed image $S_{PCD1}$. In one embodiment, the decompressed image $S_{PCD1}$ is the same as the input image $S_{I1}$.

The processing unit 204 processes the processed image $S_{P2}$ and the decompressed image $S_{PCD1}$ to generate an output image $S_{DATA2}$ according to the OD procedure. The display panel 101 displays a second image according to the output image $S_{DATA2}$. In this embodiment, when the processing unit 204 processes the processed image $S_{P2}$, the compression unit 202 compresses a data segment, which was processed by the processing unit 204 and stores the compressed result to the storage module 205. Thus, after the processing unit 204 finishes the OD procedure, the compression unit 202 also finishes a compression action for the processed image $S_{P2}$ and generates the compressed image $S_{PC2}$. The compressed image $S_{PC2}$ replaces the input image $S_{I2}$ stored in the storage module 205.

During a third period, the receiving unit 201 receives and stores the input image $S_{I3}$. The processing unit 204 reads the input image $S_{I3}$ stored in the receiving unit 201, wherein the read result is served as a processed image $S_{P3}$. The decompression unit 203 reads and decompresses the compressed image $S_{PC2}$ stored in the storage unit 205 to generate a decompressed image $S_{PCD2}$. In one embodiment, the decompressed image $S_{PCD2}$ is the same as the input image $S_{I2}$.

The processing unit 204 processes the processed image $S_{P3}$ and the decompressed image $S_{PCD2}$ to generate an output image $S_{DATA3}$ according to the OD procedure. The display panel 101 displays a third image according to the output image $S_{DATA3}$. When the processing unit 204 processes the processed image $S_{P3}$, the compression unit 202 compresses a data segment, which was processed by the processing unit 204 and stores the compressed result to the storage module 205. Thus, after the processing unit 204 finishes the OD procedure, the compression unit 202 also finishes a compression action for the processed image $S_{P3}$ and generates the compressed image $S_{PC3}$. The compressed image $S_{PC3}$ replaces the input image $S_{I3}$ stored in the storage module 205.

In this embodiment, since the processing unit 204 executes the OD procedure for two images, a response speed of the display panel 101 is quick. Furthermore, since the OD procedure does not require the previous image to have high completeness, when the compression unit 202 compresses the previous image and stores the compressed result to the storage module 205, the OD efficiency can be maintained and the bandwidth of the storage module 205 can be reduced.

Figure 3:
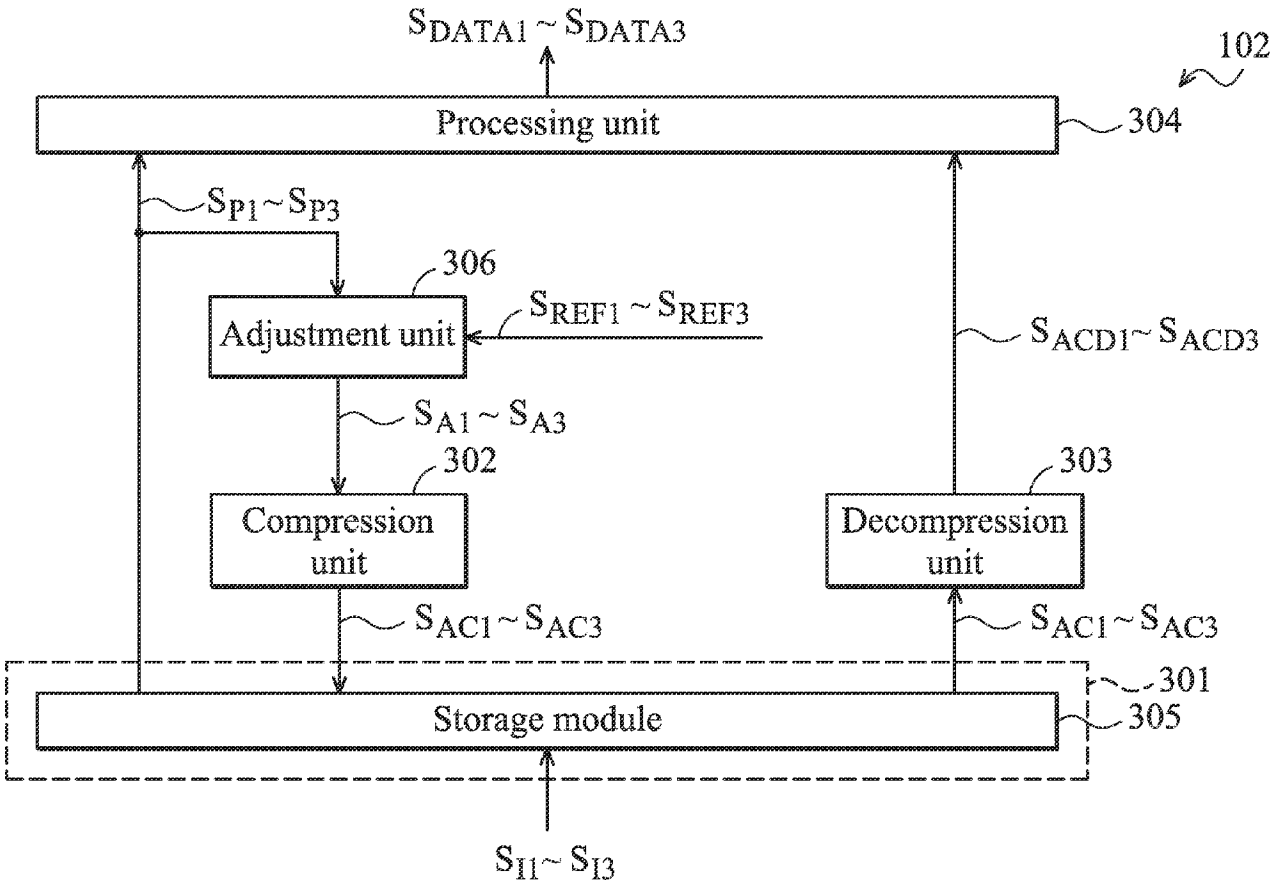

FIG. 3 is a schematic diagram of another exemplary embodiment of the timing controller. FIG. 3 is similar to FIG. 2 except for the addition of an adjustment unit 306. Since the receiving unit 301, the compression unit 302, the decompression unit 303 and the processing unit 304 are the same as the receiving unit 201, the compression unit 202, the decompression unit 203 and the processing unit 204, the descriptions of the receiving unit 301, the compression unit 302, the decompression unit 303 and the processing unit 304 are omitted for brevity.

In this embodiment, the adjustment unit 306 adjusts the processed images $S_{P1}$~$S_{P3}$ to generate adjusted data $S_{A1}$~$S_{A3}$ according to reference values $S_{REF1}$~$S_{REF3}$. The compression unit 302 compresses the adjusted data $S_{A1}$~$S_{A3}$ to generate compressed images $S_{AC1}$~$S_{AC3}$ and stores the compressed images $S_{AC1}$~$S_{AC3}$ to the receiving unit 301. The decompression unit 303 reads and decompresses the compressed images $S_{AC1}$~$S_{AC3}$ stored in the receiving unit 301 to generate decompressed images $S_{ACD1}$~$S_{ACD3}$.

The invention does not limit the source of the reference values $S_{REF1}$~$S_{REF3}$. In one embodiment, the reference values $S_{REF1}$~$S_{REF3}$ are pre-determined. In another embodiment, the reference values $S_{REF1}$~$S_{REF3}$ are decompressed images. For example, each of the reference values $S_{REF1}$~$S_{REF3}$ is a previous image.

The adjustment unit 306 adjusts a present image according to a previous image. In this embodiment, the decompressed image $S_{ACD1}$ is served as a previous image and the same as the input image $S_{I1}$. For example, the adjustment unit 306 adjusts the processed image $S_{P2}$ served as a present image according to the decompressed image $S_{ACD1}$ served as a previous image and provides the adjusted result to the compression unit 302.

Similarly, the adjustment unit 306 adjusts the processed image $S_{P3}$ served as a present image according to the decompressed image $S_{ACD2}$ served as a previous image and provides the adjusted result to the compression unit 302. The invention does not limit how the adjustment unit 306 adjusts the processed images $S_{P1}$~$S_{P3}$. In one embodiment, the adjustment unit 306 processes the reference value $S_{REF1}$ and the processed image $S_{P1}$ to generate the adjusted data $S_{A1}$ according to the OD procedure, processes the reference value $S_{REF2}$ and the processed image $S_{P2}$ to generate the adjusted data $S_{A2}$ according to the OD procedure, and processes the reference value $S_{REF3}$ and the processed image $S_{P3}$ to generate the adjusted data $S_{A3}$ according to the OD procedure.

Figure 4:
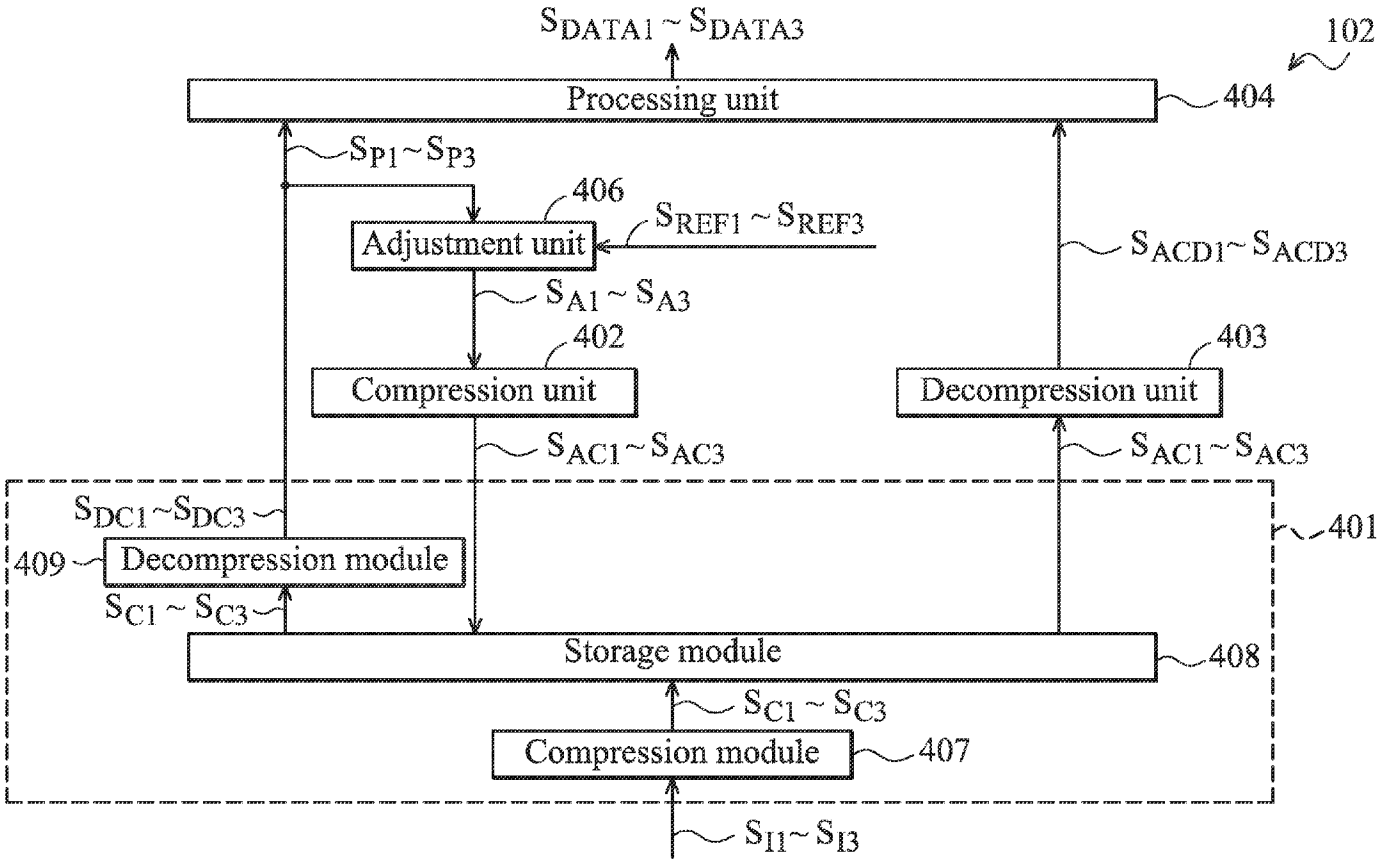

FIG. 4 is a schematic diagram of another exemplary embodiment of the timing controller. FIG. 4 is similar to FIG. 3 with the exception that the receiving unit 401 comprises a compression module 407, a storage module 408 and a decompression unit 409.

The compression module 407 compresses the input images $S_{I1}$~$S_{I3}$ to generate compressed images $S_{C1}$~$S_{C3}$. The invention does not limit the compression rates of the compression module 407 and the compression unit 202 or 302. In one embodiment, the compression rate of the compression module 407 is higher than, less than or equal to the compression rate of the compression unit 202 or 302.

The storage module 408 stores the compressed images $S_{C1}$~$S_{C3}$. In this embodiment, the storage module 408 further stores the compressed images $S_{AC1}$~$S_{AC3}$ generated by the compression unit 402. Since the storage module 408 stores the compressed images, the bandwidth of the storage module 408 can be reduced.

The decompression module 409 decompresses the compressed images $S_{C1}$~$S_{C3}$ stored in the storage module 408 to generate decompressed images $S_{DC1}$~$S_{DC3}$, serves the decompressed images $S_{DC1}$~$S_{DC3}$ as the processed images $S_{P1}$~$S_{P3}$ and provides the processed images $S_{P1}$~$S_{P3}$ to the processing unit 404. In one embodiment, the processed image $S_{P1}$ is the same as the input image $S_{I1}$, the processed image $S_{P2}$ is the same as the input image $S_{I2}$, and the processed image $S_{P3}$ is the same as the input image $S_{I3}$.

Figure 5:
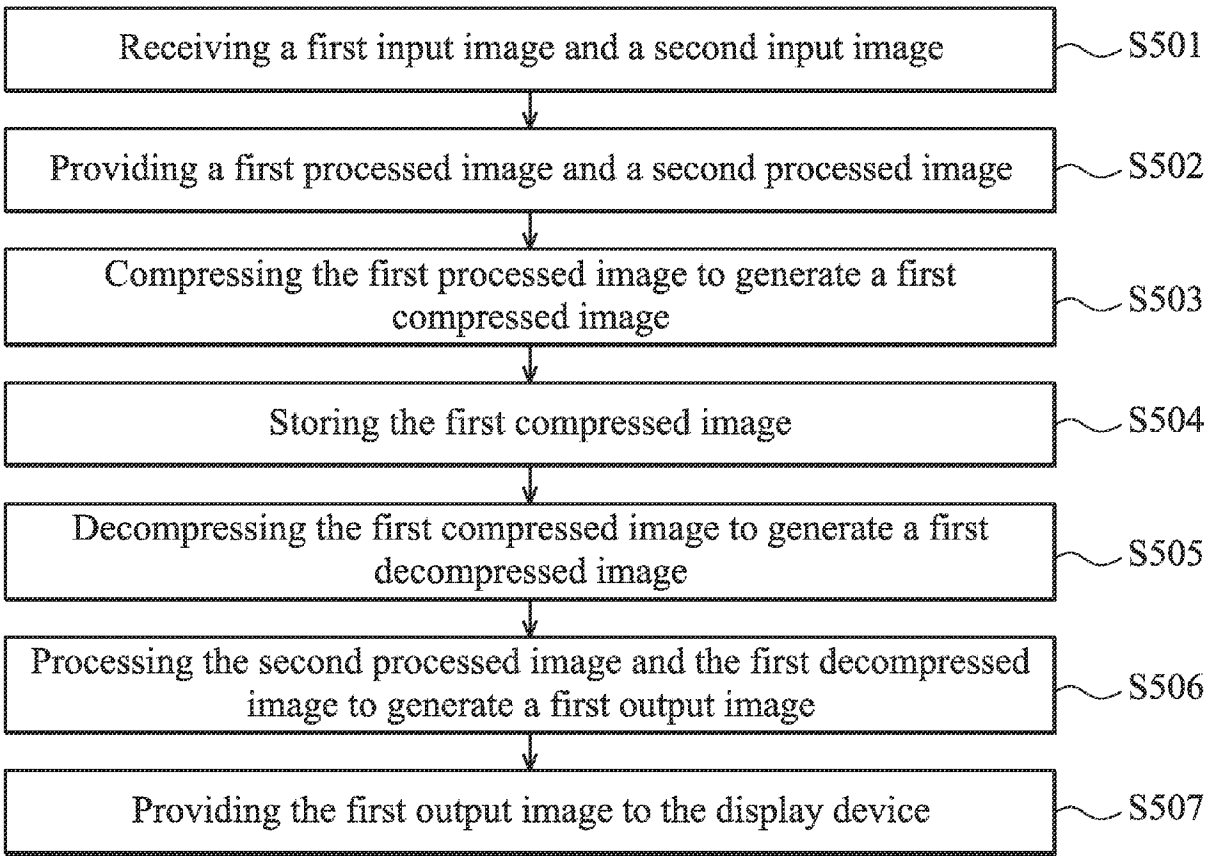
FIG. 5 is a schematic diagram of an exemplary embodiment of a control method.

FIG. 5 is a schematic diagram of an exemplary embodiment of a control method. The control method is applied for a display device to display an image. First, a first input image and a second input image are received (step S501). The invention does not limit the format of the first and the second input images. In one embodiment, the first and the second input images are in an LVDS format.

A first processed image and a second processed image are provided according to the first and the second input images (step S502). In this embodiment, the first processed image is the same as the first input image, and the second processed image is the same as the second input image. The invention does not limit how the first and the second processed images are provided according to the first and the second input images. In one embodiment, the first and the second input images are stored and served as the first and the second processed images.

Figure 6:
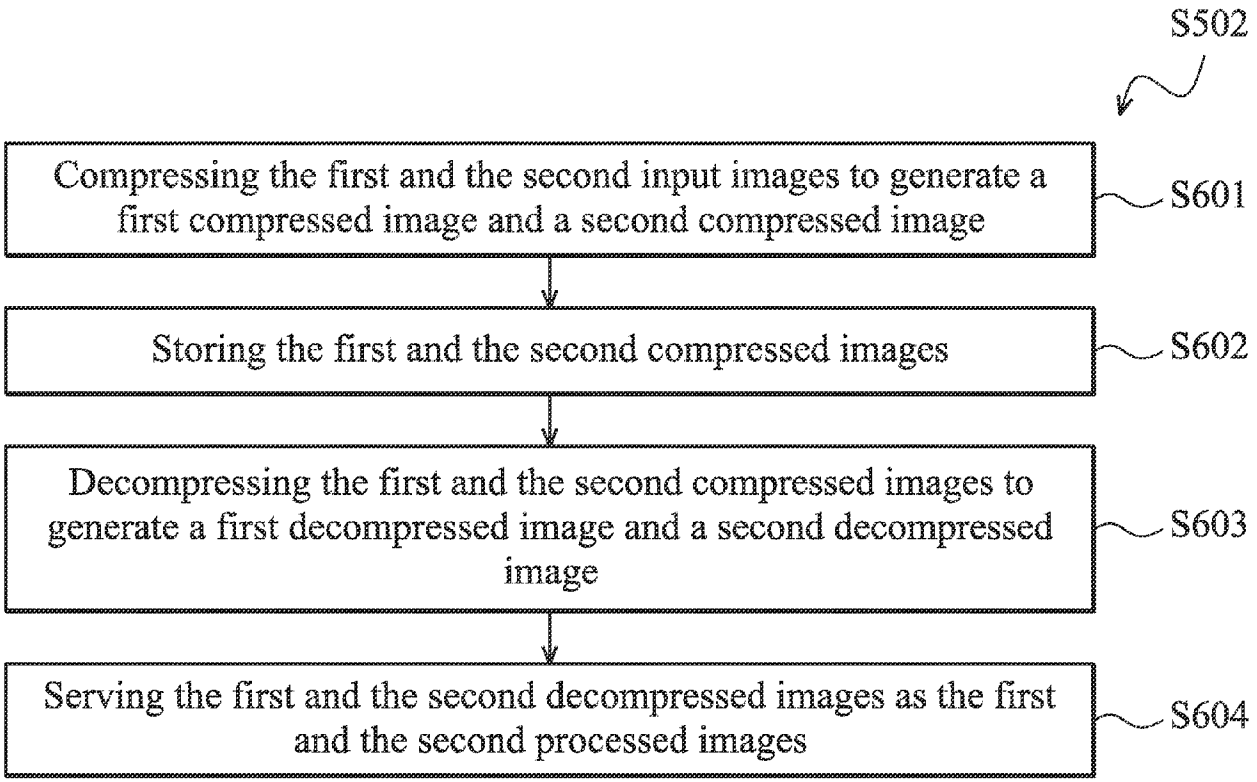
FIG. 6 is a schematic diagram of an exemplary embodiment of step S502.

FIG. 6 is a schematic diagram of an exemplary embodiment of step S502. First, the first and the second input images are compressed to generate a first compressed image and a second compressed image (step S601). Thee first and the second compressed images are stored in a memory (step S602). Since the stored images are compressed, the memory does not consume more storage space to store the images. Thus, the bandwidth of the memory is reduced.

The first and the second compressed images stored in the memory are decompressed to generate a first decompressed image and a second decompressed image (step S603). The first and the second decompressed images are served as the first and the second processed images, respectively (step S604).

Refer to FIG. 5, step S503 generates a first compressed image according to the first processed image. In this embodiment, step S503 directly compresses the first processed image. In other embodiments, the first processed image is adjusted according to a reference value and the adjusted result is compressed to generate a first compressed image. Additionally, the invention does not limit the compression rates of steps S503 and S601. For example, the compression rate of step S503 is less than, higher than, or equal to the compression rate of step S601.

In other embodiments, the first compressed image in step S503 is the same as or different from the first compressed image in step S601. Furthermore, the first processed image is processed according to an OD procedure and then compressed to generate the first compressed image.

The first compressed image is stored (step S504). In one embodiment, a memory (e.g. DRAM) is utilized to store the first compressed image. In other embodiments, other storage medium is utilized to store the first compressed image. Additionally, the first and the second input images in step S501 or the first and the second compressed images in step S602 is stored in the DRAM.

The first compressed image is decompressed to generate a first decompressed image (step S505). The invention does not limit the decompression rates of steps S505 and S603. In one embodiment, the decompression rates of steps S505 and S603 are the same.

The second processed image and the first decompressed image are processed to generate a first output image (step S506) and then the first output image is provided to the display device to display an image (step S507). The invention does not limit the kind of the display device. In one embodiment, the display device has a self-luminescent panel or a reflective panel.

Additionally, in one embodiment, step S506 is to process the second processed image and the first decompressed image according to an OD procedure, but the disclosure is not limited thereto. In other embodiments, the second processed image and the first decompressed image are processed according to other image procedures.

Furthermore, assume the display device is required to display another image. The second processed image is compressed and the compressed result is stored in the DRAM to replace the stored second processed image.

Next, a third input image is received. A third processed image is generated according to the third input image. At this time, the compressed result stored in the DRAM is decompressed and the decompressed result and the third processed image are processed to generate a second output image according to the OD procedure. The display device displays another image according to the second output image.

In other embodiment, before compressing the second processed image, the second processed image is adjusted to generate adjusted data according to a reference value. Then the adjusted data is compressed. The invention does not limit the source of the reference value. In one embodiment, the reference value is the first decompressed image.

In addition, the invention does not limit how the second processed image is adjusted according to a reference value. In one embodiment, the reference value and the second processed image are processed according to an OD procedure and the processed result is served as adjusted data.

In summary, since the previous image is compressed, the display device does not require a memory with large storage space and the bandwidth of the memory can be reduced. Furthermore, after decompressing an image, the decompressed result (i.e. the previous image) and the present image are processed according to the OD procedure such that the display device speedily displays images.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A display device, comprising:

a display panel displaying a first image according to a first output image; and a timing controller comprising:

a receiving unit receiving a first input image and a second input image and outputting a first processed image and a second processed image, wherein the first input image is the same as the first processed image, and the second input image is the same as the second processed image;

a compression unit generating a first compressed image according to the first processed image, wherein the receiving unit stores the first compressed image;

a decompression unit processing the first compressed image stored in the receiving unit to generate a first decompressed image;

a processing unit processing the second processed image and the first decompressed image to generate the first output image; and an adjustment unit adjusting the second processed image to generate adjusted data according to a reference value, wherein the compression unit compresses the adjusted data to generate a second compressed image, the receiving unit stores the second compressed image, the decompression unit processes the second compressed image stored in the receiving unit to generate a second decompressed image, the processing unit processes a third processed image and the second decompressed image to generate a second output image, and the display panel displays a second image according to the second output image.

2. The display device as claimed in claim 1, wherein the processing unit processes the second processed image and the first decompressed image according to an overdriving procedure.

3. The display device as claimed in claim 1, wherein the receiving unit comprises a storage module storing the first and the second input images and serving the first and the second input images as the first and the second processed images.

4. The display device as claimed in claim 1, wherein the first decompressed image is the same as the first input image.

5. The display device as claimed in claim 1, wherein the compression unit compresses the first processed image to generate the first compressed image.

6. The display device as claimed in claim 1, wherein the reference value is the first decompressed image.

7. The display device as claimed in claim 6, wherein the adjustment unit processes the reference value and the second processed image to generate the adjusted image according to an overdriving procedure.

8. The display device as claimed in claim 1, wherein the receiving unit comprises:

a compression module compressing the first input image to generate a second compressed image and compressing the second input image to generate a third compressed image;

a storage module storing the second and the third compressed images; and a decompression module decompressing the second compressed image stored in the storage module to generate a second decompressed image and decompressing the third compressed image stored in the storage module to generate a third decompressed image, wherein the second decompressed image is served as the first processed image and the third decompressed image is served as the second processed image.

9. The display device as claimed in claim 8, wherein the second decompressed image is the same as the first input image, and the third decompressed image is the same as the second input image.

10. The display device as claimed in claim 1, wherein a resolution of the display panel is 3840×2160.

11. A control method for a display device, comprising:

receiving a first input image and a second input image;

providing a first processed image and a second processed image according to the first and the second input images, wherein the first processed image is the same as the first input image, and the second processed image is the same as the second input image;

generating a first compressed image according to the first processed image;

storing the first compressed image;

decompressing the stored first compressed image to generate a first decompressed image;

processing the second processed image and the first decompressed image to generate a first output image;

providing the first output image to the display device to display a first image;

adjusting the second processed image to generate adjustment data according to a reference value;

compressing the adjustment data to generate a second compressed image;

storing the second compressed image;

decompressing the stored second compressed image to generate a second decompressed image;

processing a third processed image and the second decompressed image to generate a second output image; and providing the second output image to the display device to display a second image.

12. The control method as claimed in claim 11, wherein the step of processing the second processed image and the first decompressed image to generate the first output image is to process the second processed image and the first decompressed image according to an overdriving procedure.

13. The control method as claimed in claim 11, wherein the step of providing the first processed image and the second processed image according to the first and the second input images comprises:

storing the first and the second input images;

reading the stored first input image to generate a first reading result and serving the first reading result as the first processed image; and reading the stored second input image to generate a second reading result and serving the second reading result as the second processed image.

14. The control method as claimed in claim 11, wherein the first decompressed image is the same as the first input image.

15. The control method as claimed in claim 11, wherein the reference value is the first decompressed image.

16. The control method as claimed in claim 15, wherein the step of adjusting the second processed image to generate the adjustment data according to the reference value comprises:

processing the reference value and the second processed image according to an overdriving procedure.

17. The control method as claimed in claim 11, wherein the step of providing the first processed image and the second processed image according to the first and the second input images comprises:

compressing the first input image to generate a second compressed image and compressing the second input image to generate a third compressed image;

storing the second and the third compressed images;

decompressing the stored second compressed image to generate a second decompressed image and decompressing the stored third compressed image to generate a third decompressed image; and serving the second decompressed image as the first processed image and serving the third decompressed image as the second processed image.

18. The control method as claimed in claim 17, wherein the second decompressed image is the same as the first input image, and the third decompressed image is the same as the second input image.

* * * * *